US010428519B2

(12) United States Patent
Divito et al.

(10) Patent No.: US 10,428,519 B2
(45) Date of Patent: Oct. 1, 2019

(54) WRAPS FOR STEEL LINTELS

(71) Applicant: Angle Wrap Ltd., Belle Ewart, Ontario (CA)

(72) Inventors: Bruno Divito, Belle Ewart (CA); Manuele Scarati, Barrie (CA)

(73) Assignees: Angle Armour Inc., Belle Ewart (CA); Lintel Wrap Ltd., Barrie (CA)

( * ) Notice: Subject to any disclaimer, the term of this patent is extended or adjusted under 35 U.S.C. 154(b) by 0 days.

(21) Appl. No.: 15/852,584

(22) Filed: Dec. 22, 2017

(65) Prior Publication Data

US 2019/0194934 A1 Jun. 27, 2019

(51) Int. Cl.
*E04B 1/64* (2006.01)
*E04C 3/02* (2006.01)
*E04B 2/02* (2006.01)

(52) U.S. Cl.
CPC ..... *E04B 1/642* (2013.01); *E04B 2/02* (2013.01); *E04C 3/02* (2013.01); *E04B 2002/0256* (2013.01); *E04C 2003/023* (2013.01)

(58) Field of Classification Search
CPC ..... E04B 1/642; E04C 2003/023
USPC ..... 52/204.2
See application file for complete search history.

(56) References Cited

U.S. PATENT DOCUMENTS 3,605,356 A * 9/1971 Bordner ..... E06B 1/702 52/11
3,875,713 A * 4/1975 Laborde ..... E06B 1/342 52/213
4,019,301 A * 4/1977 Fox ..... E02D 5/60 405/216
4,280,308 A * 7/1981 Svensson ..... E04B 1/7046 52/204.2
4,423,575 A * 1/1984 Lagergren ..... E06B 3/302 52/204.53
5,222,345 A * 6/1993 Riley ..... E06B 1/34 52/716.1
5,584,150 A 12/1996 Newman
5,653,072 A * 8/1997 Seelandt-Stasek ..... E06B 1/702 52/100
5,815,986 A * 10/1998 Laska ..... E04B 1/703 52/62
6,360,500 B1 * 3/2002 Wilcox ..... E06B 1/702 52/211
6,889,474 B2 * 5/2005 Wesdock ..... E04F 10/005 52/204.53

(Continued)

FOREIGN PATENT DOCUMENTS

GB 2118585 11/1983

OTHER PUBLICATIONS

Catnic: Lintel Soft Cladding—Type RC and FC.
CIPO Examination Report dated May 9, 2018.

*Primary Examiner* — Paola Agudelo
(74) *Attorney, Agent, or Firm* — Chumak & Co LLP; Yuri Chumak

(57) ABSTRACT

According to embodiments described in the specification, a wrap for a steel lintel positioned above a structural opening of a structure includes a plastic sheet member for placement on the steel lintel wherein the plastic sheet member is contoured to cover the steel lintel across a width of the structural opening; and wherein the plastic sheet member extends to cover a lower flange of the steel lintel providing a flashing at an interior angle of the steel lintel.

8 Claims, 3 Drawing Sheets

(56) References Cited

U.S. PATENT DOCUMENTS

| | | | | |
|---|---|---|---|---|
| 6,964,136 | B2 * | 11/2005 | Collins | E04B 1/70 52/204.2 |
| 2005/0210787 | A1 * | 9/2005 | Koester | E04F 17/00 52/302.1 |
| 2005/0284045 | A1 * | 12/2005 | Smith | E04B 1/7046 52/204.2 |

* cited by examiner

WRAPS FOR STEEL LINTELS

FIELD OF TECHNOLOGY

The present disclosure relates to steel lintels (also known as angle irons) and, in particular, to accessories or wraps for steel lintels.

BACKGROUND

Steel lintels, or angle irons, are typically found over window and door openings in residential and commercial properties. The purpose of a steel lintel is to support the weight of the bricks or masonry blocks above the openings. Often the steel lintel is installed as delivered, with a coat of primer paint. Most builders then paint the steel lintel, or some portion thereof, to match the colour of an exterior feature, be it a door or a window frame, or the like. However, when a portion of the steel lintel, painted or otherwise, is exposed to the elements, over time, unsightly rust or corrosion occurs. Often the exposed areas that become corroded include the bottom portion of the steel lintel (above the opening) and at the front edge of the steel lintel.

Various techniques have been developed to address the rusting and corrosion of steel lintels. As mentioned, steel lintels are exposed to the elements making them susceptible to oxidation. This results in an unsightly appearance and a need for regular and costly maintenance, in the form of painting.

Various steel lintel covers are known, but existing designs suffer from several disadvantages because, for example, they trap water and mask an underlying problem. An example of this is found in U.S. Pat. No. 5,584,150 to Newman, which discloses an angle iron cover that is removably secured to an angle iron. According to Newman, rusting (if it occurs) is hidden via a "securing means" (lip) of the cover, the design of which causes water to intrude or pool within. Use of lintel covers of existing designs can accelerate the deterioration of the steel causing damage to the adjacent brick and masonry. Previous lintel covers are not multifunctional in that they may act as a covering and not a flashing as well.

According to current solutions, corrosion can be addressed as part of a regular maintenance program. The corroded material can be removed manually, as by grinding or sanding, and the surface of the steel lintel repainted. Again, this approach is not desirable. Not only is the process labour-intensive, but also limited areas of corrosion can be remediated, and as mentioned, the corrosion could affect materials adjacent to the steel lintel such as the bricks that are more difficult to re-surface.

Improvements in steel lintels and accessories are desirable. For example, there is a need for the design and development of a cover or wrap for steel lintels providing improved or alternative means of water tightness, that is convenient to install, finish and maintain, and that is simple and less costly to manufacture in scale and with fewer parts.

The foregoing examples of the related art and limitations related thereto are intended to be illustrative and not exclusive. Other limitations of the related art will become apparent to those of skill in the art upon a reading of the specification and a review of the drawings.

BRIEF DESCRIPTION OF THE DRAWINGS

Examples are illustrated with reference to the attached drawings. It is intended that the examples and figures disclosed herein be considered illustrative rather than restrictive.

DETAILED DESCRIPTION

The following describes a wrap for a steel lintel positioned above a structural opening of a structure. The wrap includes a plastic sheet member for placement on the steel lintel wherein the plastic member is contoured to cover the steel lintel across a width of the structural opening; and wherein the plastic member extends to cover a lower flange of the steel lintel providing a flashing at an interior angle of the steel lintel.

Throughout the following description, specific details are set forth in order to provide a more thorough understanding to persons skilled in the art. However, well-known elements may not be shown or described in detail to avoid unnecessarily obscuring of the disclosure. Accordingly, the description and drawings are to be regarded in an illustrative, rather than a restrictive, sense.

This disclosure relates generally to steel lintels, or angle irons, and particularly to accessories and wraps for steel lintels.

Figure 1:
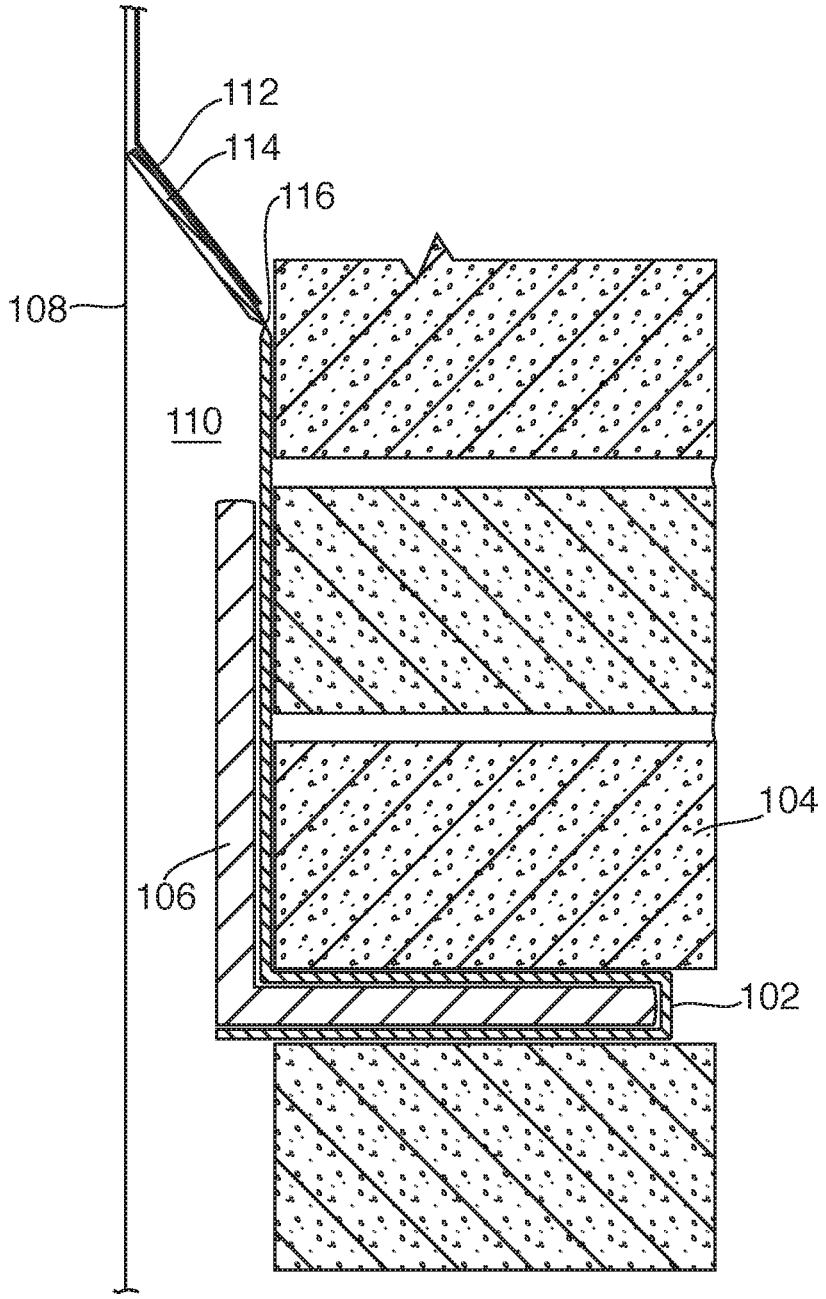
FIG. 1 is a cross-sectional view of a wrap for a steel lintel, shown in an environment, in accordance with an example.

Referring first to FIG. 1, a wrap in accordance with the present specification is generally indicated by reference numeral 102 and is shown in association with a structure 108, which can be a building or house. The structure 108 can be made of wood and frames the home or building; its functionality is structural. The structure 108 is faced with bricks (or blocks) 104. The term "bricks" refers to any rectangular units of clay or other material laid in mortar building used to make walls or other vertical supports. The bricks 104 function as an exterior veneer, to dress the exterior of a building or home. Moreover, the bricks 104 can also serve to protect a home's wood frame from the elements. As shown in the cross-sectional view of FIG. 1, a top end of the wrap 102 is attached to a steel lintel 106 by use of tape 112.

Use of the term "steel lintel" extends to any structural horizontal block that spans the space or opening between two vertical supports. Often manufactured using structural steel, a lintel could also be made of other materials. The present specification is not intended to be limited to the use of structural steel. With reference to FIG. 1., the steel lintel 106 is shown generally as an L-shaped member, with the lower member referred to as a flange, that supports the weight of bricks 104 above an opening, which may be a door opening, a window opening, a portal opening, a fireplace opening, or any other type of opening. The terms angle irons, steel lintels, and steel angle lintels are interchangeable.

Use of the term "wrap" extends to any extruded, planar plastic sheet or other sheet-like, water-resistant material. The wrap 102 may be of uniform thickness and uniform profile, in one example. The wrap 102 may feature specific properties such as UV-absorption, texture, oxygen permeation, water resistance, and the like. According to one example, the thickness of the wrap 102 can be designed to be thin enough so as not to compromise the mortar joint in the bricks 104. For example, it has been discovered that a thickness of between 0.045 to 0.055 inches is suitable. Other dimensions are possible without departing from the scope of the present specification. Being fabricated from thin sheets of plastic by extrusion, according to one example, the wrap 102 can be manufactured to fit small and large structural openings, and larger sections of the wrap 102 can be cut into smaller pieces for a precise fit. Generally speaking, the wrap 102 is sized to cover the width of the structural opening; the width of the steel lintel 106 can be longer and is determined by, among other factors, the width of the structural opening and the load to be supported. Advantageously, the wrap 102 is an accessory for use with steel lintels 106 that are in common use.

As mentioned, the wrap 102 can be fabricated from plastic that is selected to match an exterior feature of the construction project, such as a standardized window frame colour. In other words, the wrap 102 can be colour-coordinated with the project's exterior colour scheme. Advantageously, the exposed areas of the wrap 102 can finish the bottom of the steel lintel 106 and there is no need to paint the steel lintel 106. According to disclosed examples, the wrap 102 functions as a decorative covering for exposed portions of the steel lintel 106 (located in brick buildings) and as a flashing or vapour barrier that diverts the passage of water over the steel lintel 106 and away from the structure 108 thereby preventing water pooling and oxidation of the steel lintel 106.

The term "tape" can refer to house wrap or tuck tape, for example, as sold under the trademark TYVEK. According to one example, the tape 112 can be made of UV resistant poly propylene film that is coated with a high shear, a high tack solvent-based acrylic adhesive. Common applications of the tape 112 include sealing of joints and seams of house wrap. Any tape that provides a vapour barrier can be used without departing from the scope of the present specification. The tape 112 serves to protect the structure 108, which may be made of wood, from weathering. The tape 112 can be a barrier that serves to protect the structure 108 (i.e., the frame) from moisture. Still with reference to FIG. 1, one end of the wrap 102 is secured to the structure 108 by the use of the tape 112 in a configuration that permits an air space 110 to form. It will be appreciated that, according to disclosed examples, the wrap 102 directly wraps or covers the steel lintel except for a rear vertical portion of the steel lintel defining the air space 110. This "complete coverage" the steel lintel 106 on all faces but the back face parallel to the structure 108 allows moisture to be diverted away from the steel lintel 106 and structure 108 instead of promoting pooling. As discussed below with reference to the hinge bend 116 and angled flap 114, this design allows the preservation of an air space 110 preventing or reducing moisture from pooling in exposed openings. The angled flap 114 can be taped to the house wrap (using tape 112) or the house wrap (tar paper) can be draped over the vertical wall 308 (shown in FIG. 3). Use of the tape 112 seals the air space 110 allowing moisture, which normally drains through the air space 110 to flow over the steel lintel 106 and into weep holes (discussed below with reference to FIG. 2) of the bricks 104 where it may continue to drain away from the structure 108. The air space 110 acts as a buffer between the structure 108 and the exterior of the building or home (faced with bricks 104), diminishing the effects of temperature differences. Generally speaking, brick acts a reservoir of absorbed water, and when heated a vapor pressure is created that drives the vapor inward, without the air space 110, this pressure would condense on cooler structure surface. By tying in the vapour barrier, there is a continuous covering protecting the structure 108, various structural elements (including the wood frame of the structure 108 and the steel lintel 106) from moisture. According to one example, the wrap 102 completely engulfs the steel lintel 106 diverting moisture away from the structure 108 and the steel lintel 106. The design of the wrap 102 accounts for instances in which brick weep holes 204 become clogged, further protecting the steel lintel 106 from weathering and corrosion.

In brick veneer structures, the bricks 104 are laid until an opening is reached at which point bricks 104 are placed around the opening. When a steel lintel 106 is placed in order to lay a brick veneer above the opening, the wrap 102 is installed on the steel lintel 106. The "over-under" design of the wrap 102 allows for complete coverage of the L-shaped steel lintel 106. Bricks 104 are then continued to be laid above the wrap-covered steel lintel 106 across the opening. Bricks 104 are placed in according to a standard, such as the building code.

Additionally, by diverting precipitation away from the structure, the wrap 102 can aid in protecting the steel lintel 106 from weathering, in compliance with the Ontario building code. In this regard, section 9.20.5.1. (5) of the Ontario Building Code states that steel lintels supporting masonry shall be primed or painted or otherwise protected from corrosion. It has been discovered that solely priming or painting steel lintels may not protect the steel lintel from corrosion which results in exposed, unsightly, and maintenance burdened steel lintels.

Furthermore, section 9.27.4.2. (1)(b). states that materials shall be selected for their ability to resist the effects of weathering. Accordingly, there is a motivation to provide an aesthetic flashing or lintel cover designed in such a manner that it diverts moisture away from the structure 108 and prevents the pooling of water over the steel lintel 106. Without the diversion of moisture, steel lintels 106 may not be sufficiently protected from corrosion, nor the effects of weathering. Although there have been products designed to aesthetically cover the steel lintel 106, some prior solutions are limited and function as water traps to expedite the corrosion, thus amplifying weathering effects.

Advantageously, use of the wrap 102 according to disclosed examples can provide a decorative covering for exposed portions of a steel lintel 106, and as a flashing that diverts the passage of water over the steel lintel 106 and away from the structure 108. In doing so the wrap 102 can prevent water pooling and oxidation of the steel lintel 106. Whereas some previous products hug the underside of the steel lintel 106, disclosed examples of the wrap 102 according to the present specification cover an upper surface of the steel lintel 106. A vertical portion or wall of the wrap 102, a hinge bend 116 and an angled flap 114 allows the wrap 102 to wholly cover the steel lintel 106 and be tied into the structure's vapour barrier, whilst accommodating the need for an air space 110 between the bricks 104 and the structure 108.

According to disclosed examples, the wrap 102 is tied into the vapour barrier house wrap by tape 112 providing a means of sealing the air space 110 creating a flashing functionality from the structure 108 to a base of the steel lintel 106. In brick-veneer structures, an air space 110 is left between the structure 108 and the bricks 104 to absorb the moisture generated from transitions in temperatures (e.g., hot to cold). Importantly, the air space 110 acts as a drainage system for moisture allowing the fluid to run down the side of the structure 108. Over openings, the vapour barrier can be draped over the steel lintel 106 to prevent the collection of water over windows and doors inserted into the openings. This may result in a pooling of water around the steel lintel 106 which can expedite the oxidation of the steel lintel 106. Lintel covers of previous designs sometimes feature a lip at the end of the lower flange of the steel lintel 106 that worsens the problem of pooling of water at an interior angle of the steel lintel 106. In instances where the vapour barrier is not draped over the steel lintel 106, moisture would drain down the air space 110 along the face of the structure 108, past the steel lintel 106 until it reached the installed windows and doors. This moisture would then pool over the windows and doors resulting in rotting of the window and door frames, and possibly the structure 108. Not draping the vapour barrier wrap over the steel lintel 106 is a common occurrence in new developments and often leads to the rotting of the window and door frames. Wraps according to examples of the present specification help to protect the steel lintel 106 from oxidation resulting in pooling of water around the steel lintel 106 when the vapour barrier and wrap 102 are installed correctly. In instances where the vapour barrier is not draped over the steel lintel 106, a hinge bend 116 allows the wrap 102 to be tied into the vapour barrier, by taping, thus sealing the air space 110. An angled flap 114 connected to the hinge bend 116 diverts moisture flow away from the structure 108 and into the brick weep holes (discussed below with reference to FIG. 2) where it can continue to drain.

Advantageously, the hinge bend 116 can serve to mitigate rotting of the framing around windows and doors as well as oxidation of the steel lintels 106.

Figure 2:
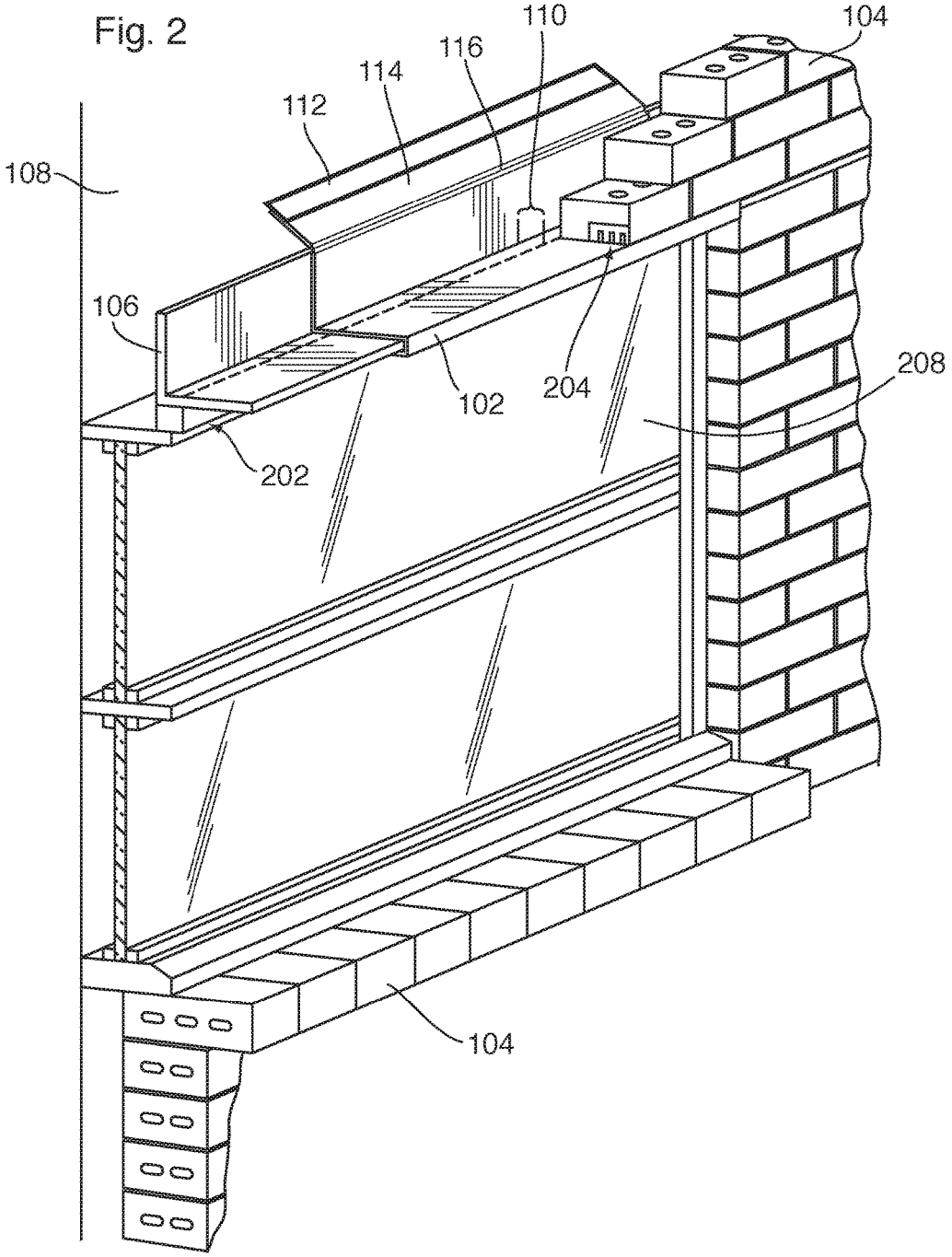
FIG. 2 is a first perspective view of the wrap of FIG. 1.

Now with reference to FIG. 2, showing a first perspective view of the wrap 102 in an environment, it will be appreciated that the wrap 102 extends across the steel lintel 106 along a width of a structural opening, such as the window 208. According to one example, the wrap 102 is taped to the structure 108 using tape 112. FIG. 2. illustrates the weep holes 204 located within the bricks 104. In one example, not all bricks 104 include weep holes 204, but every third brick 104 includes weep holes 204. Use of the term "weep hole" extends to any small opening that allows water to drain from within an assembly. According to the present specification, weep holes 204 are located at the bottom of the bricks 104, within the joints, to allow for drainage. The weep holes 204 of some or all of the bricks 104 are located above the window 208 to prevent moisture from intruding within.

The wrap 102 is taped into the vapour barrier using tape 112 which allows moisture to drain over and around the steel lintel 106 through the weep holes 204 in the bricks. Area 110 depicts the air space left between the bricks and the structure 108. The importance of protecting this air space 110 is discussed with reference to FIG. 1.

FIG. 2 also illustrates a brick moulding 202 that acts as a decorative element or aesthetic covering that covers the gap between bricks 104 and the structural openings including doors and windows.

In a structure 108 that utilizes a house wrap as a vapour barrier, the wrap 102 can be directly taped to the vapour barrier using tape 112. This eliminates the need to drape the vapour barrier over the steel lintel 106. Vapour barriers that do not facilitate the use of tape 112 require the vapour barrier to be draped over the steel lintel 106. The direct taping of the wrap 102 to the structure 108 and vapour barrier is enabled with the articulating features of the hinge bend 116 and the angled flap 114 as described in the present specification.

Figure 3:
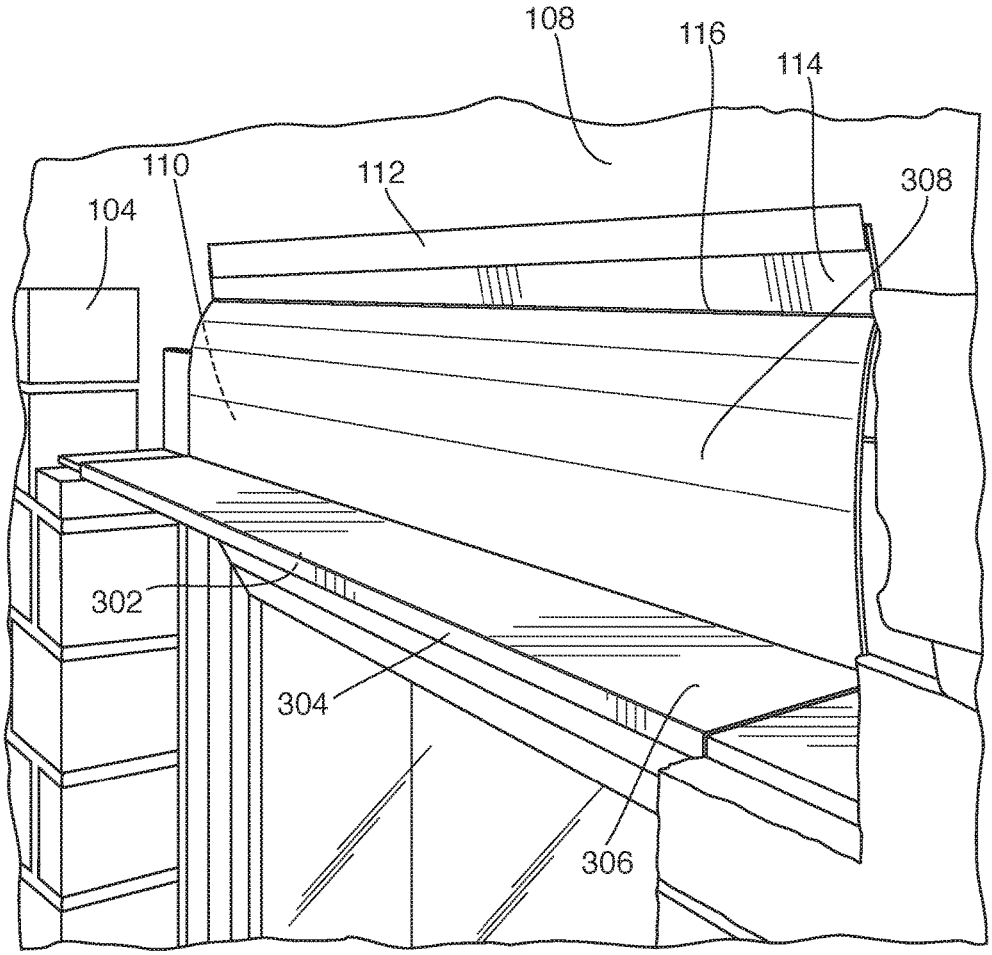
FIG. 3 is a second, close-up perspective view of the wrap of FIG. 1.

Turning now to FIG. 3, a close-up perspective view of the wrap 102 is shown. A lower horizontal portion 302 of the wrap 102 extends to cover a lower flange of the steel lintel 106 (i.e., the underside of the steel lintel 106). A short front edge portion 304 cover the front edge of the steel lintel 106. An upper horizontal portion 306 is hidden beneath the bricks 104 spanning over the structural opening (e.g., a window). A vertical portion 308 acts as a "third wall" from the top to keep moisture and water from the steel lintel 106 and channeling the water away from the structure 108 through the weep holes 204. The vertical portion 308 can be said to "complete" the integrated flashing. As mentioned above, the hinge bend 116 creates flexibility for the angled flap 114 to accommodate varying air gaps between the structure 108 and the bricks 104. In a case of little or no air gap the angled flap 114 can be oriented at a vertical position, in the case of a one inch air gap the angled flap 114 can be oriented at about a forty-five degree angle from the vertical portion 308 to the structure 108.

According to some examples, the location of the hinge bend 116 can be adjusted during fabrication or installation of the wrap 102. The hinge bend 116 can be located at any position along the vertical dimension of the angled flap 114. For example, locating the hinge bend 116 closer to the top end of the wrap 102 permits the angled flap 114 to be oriented at a position that is closer to vertical. On the other hand, locating the hinge bend 116 away from the top end of the wrap 102 permits the angled flap 114 to be oriented at about a forty-five degree angle from the vertical portion 308 to the structure 108. Other angle measurements are possible without departing from the scope of the present specification. As well, the wrap 102 can include more than one hinge bend 116 and/or angled flap 114. According to one example, the angle of the angled flap 114 changes based on the location of the hinge bend 116.

Advantageously, use of the wrap 102 prevents moisture from making its way down the structure 108 and onto the top of window 208 (or door openings) minimizing water damage. As well, use of the wrap 102 provides a decorative covering for exposed steel lintels in brick veneer building. Furthermore, use of the wrap 102 provides a flashing that diverts the passage of water over the steel lintel 106 and away from the structure 108, thereby preventing water pooling and rust oxidation of the steel lintels. Still further, use of the wrap 102 seals the air space 110 and diverts moisture over and around the steel lintel 106.

The present specification provides a wrap for a steel lintel positioned above a structural opening of a structure including a plastic sheet member for placement on the steel lintel. The plastic sheet member is contoured to cover the steel lintel across a width of the structural opening. The plastic sheet member extends to cover a lower flange of the steel lintel providing a flashing at an interior angle of the steel lintel. The wrap can be fabricated from extruded plastic and maintains a uniform thickness and uniform profile across the width.

A top end of the plastic sheet member includes a flap and a hinge bend. When installed, a sealed air space is formed at a location between the structure and the steel lintel.

A tape seals the flap to the structure, creating a vapour barrier to prevent an intrusion of moisture within the sealed air space, behind the steel lintel.

The plastic sheet member includes a finished portion extending to cover a lower surface of the lower flange of the steel lintel.

The structural opening can be a window and the finished portion of the plastic sheet member can be colour-matched to a frame of window.

The flap can be adjustable to accommodate a size of the sealed air space.

Some of the bricks installed with the wrap include weep holes that channel water from the sealed air space, flowing over the wrapped steel lintel and into the weep holes where the water continues to drain downwards along the structure.

In one example, the plastic sheet member covers the steel lintel except for a rear vertical portion of the steel lintel.

According to disclosed examples, a method of installing wrap includes the steps of: terminating a house wrap at a level of a steel lintel positioned above a structural opening; placing the wrap on the steel lintel so that the wrap is contoured to cover the steel lintel across a width of the structural opening; installing bricks on top of the wrapped steel lintel and maintaining the sealed air space between the bricks and the structure; bending the top end of the plastic sheet member to be proximate to the house wrap; and taping the top end of the plastic sheet member to the house wrap forming a vapour barrier.

While a number of exemplary aspects and examples have been discussed above, those of skill in the art will recognize certain modifications, permutations, additions and sub-combinations thereof

The invention claimed is:

1. A wrap for a steel lintel positioned above a structural opening of a structure comprising:

a plastic sheet member for placement on the steel lintel wherein the plastic sheet member is contoured to cover the steel lintel across a width of the structural opening;

wherein the plastic sheet member extends to cover a bottom surface of a lower flange of the steel lintel providing a flashing at an interior angle of the steel lintel;

wherein the wrap is fabricated from extruded plastic and maintains a uniform thickness and uniform profile across the width; and wherein a top end of the plastic sheet member comprises a flap and a hinge bend that when installed forms a sealed air space at a location between the structure and the steel lintel.

2. The wrap of claim 1, further comprising a tape for sealing the flap to the structure and creating a vapour barrier to prevent an intrusion of moisture within the sealed air space behind the steel lintel.

3. The wrap of claim 2, wherein the plastic sheet member comprises a finished portion extending to cover a lower surface of the lower flange of the steel lintel.

4. The wrap of claim 3 wherein the structural opening is a window and the finished portion of the plastic sheet member is colour-matched to a frame of window.

5. A method of installing the wrap of claim 3 comprising the steps of:

a) terminating a house wrap at a level of the steel lintel positioned above the structural opening;

b) placing the wrap on the steel lintel so that the wrap 5 is contoured to cover the steel lintel across the width of the structural opening;

c) installing bricks on top of the wrapped steel lintel and maintaining the sealed air space between the bricks and the structure;

d) bending a top end of the plastic sheet member to be proximate to the house wrap; and taping the top end of the plastic sheet member to the house wrap forming a vapour barrier.

6. The wrap of claim 1 wherein the flap is adjustable to accommodate a size of the sealed air space.

7. The wrap of claim 1 wherein the wrap is installed with bricks that comprise weep holes that are configured to channel water from the sealed air space, by directing the water to flow over the wrapped steel lintel and into the weep holes and away from the structure.

8. The wrap of claim 1 wherein the plastic sheet member covers the steel lintel except for a rear vertical portion of the steel lintel.

* * * * *